US009985359B2

(12) United States Patent
Jarzebiak et al.

(10) Patent No.: US 9,985,359 B2
(45) Date of Patent: May 29, 2018

(54) FIELD TERMINABLE TELECOMMUNICATIONS CONNECTOR

(71) Applicant: The Siemon Company, Watertown, CT (US)

(72) Inventors: Richard Jarzebiak, Stratford, CT (US); Randy Below, Chesire, CT (US); David Giampietro, Watertown, CT (US); John Gogol, Wolcott, CT (US); Bob Harisi, Waterbury, CT (US); Joseph Favale, Sr., Watertown, CT (US)

(73) Assignee: THE SIEMON COMPANY, Watertown, CT (US)

( * ) Notice: Subject to any disclaimer, the term of this patent is extended or adjusted under 35 U.S.C. 154(b) by 0 days. days.

(21) Appl. No.: 15/454,289

(22) Filed: Mar. 9, 2017

(65) Prior Publication Data

US 2017/0264044 A1 Sep. 14, 2017

Related U.S. Application Data

(60) Provisional application No. 62/306,779, filed on Mar. 11, 2016.

(51) Int. Cl.

| | |
|---|---|
| ***H01R 4/24*** | (2018.01) |
| ***H01R 13/50*** | (2006.01) |
| ***H01R 13/66*** | (2006.01) |
| ***H01R 24/64*** | (2011.01) |

(52) U.S. Cl.

CPC ..... *H01R 4/2433* (2013.01); *H01R 13/501* (2013.01); *H01R 13/6658* (2013.01); *H01R 24/64* (2013.01)

(58) Field of Classification Search

CPC ..... H01R 13/5833; H01R 4/2416; H01R 13/502; H01R 23/025; H01R 23/005; H01R 13/6658; H05K 1/0228; H05K 2201/10189

USPC ..... 439/395, 676, 404, 405, 417

See application file for complete search history.

(56) References Cited

U.S. PATENT DOCUMENTS

| | | | | | |
|---|---|---|---|---|---|
| 3,777,223 | A * | 12/1973 | Chandler | H01R 4/2462 | 174/72 A |
| 4,756,695 | A * | 7/1988 | Lane | H01R 24/62 | 439/535 |
| 4,780,917 | A * | 11/1988 | Hancock | A61H 33/02 | 4/541.2 |
| 5,295,869 | A * | 3/1994 | Siemon | G02B 6/3897 | 361/301.1 |

(Continued)

FOREIGN PATENT DOCUMENTS

DE 102012111129 A1 5/2014

*Primary Examiner* — Abdullah Riyami
*Assistant Examiner* — Vladimir Imas
(74) *Attorney, Agent, or Firm* — Cantor Colburn LLP

(57) ABSTRACT

A connector includes a modular connector including: a connector body; a substrate positioned in the connector body; wire termination contacts electrically coupled to the substrate; connector contacts electrically coupled to the substrate; the substrate including traces that electrically connect each of the wire contacts to a respective one of the connector contacts; a lacing cap subassembly including: a lacing cap having a plurality of wire receiving slots; a lacing cap body coupled to the lacing cap; a lacing cap door hingedly coupled to the lacing cap body, the lacing cap door moveable between an open and closed position.

15 Claims, 18 Drawing Sheets

(56) References Cited

U.S. PATENT DOCUMENTS 5,501,617 A * 3/1996 Arnett ..... H01R 4/2433 439/404
5,791,943 A * 8/1998 Lo ..... H01R 13/6397 439/491
5,807,139 A * 9/1998 Volansky ..... H01R 13/518 439/491
5,975,936 A 11/1999 Lin et al.
6,305,950 B1 * 10/2001 Doorhy ..... H01R 24/64 439/76.1
6,368,143 B1 4/2002 Adams
6,371,794 B1 4/2002 Bauer et al.
6,464,403 B1 * 10/2002 Koch ..... G02B 6/3893 385/139
6,616,460 B1 * 9/2003 Shimirak ..... H01R 13/701 439/49
RE38,519 E 5/2004 Doorhy et al.
6,814,624 B2 * 11/2004 Clark ..... H01R 13/506 439/676
7,101,212 B1 9/2006 Larkin
7,335,066 B2 * 2/2008 Carroll ..... H01R 4/2429 174/27
7,452,245 B2 * 11/2008 Doorhy ..... H01R 13/6463 439/456
7,604,515 B2 10/2009 Siemon et al.
7,823,281 B2 * 11/2010 Caveney ..... H05K 1/028 29/827
7,850,492 B1 * 12/2010 Straka ..... H01R 13/6625 439/676
8,298,922 B2 10/2012 Schumann et al.
8,702,442 B2 * 4/2014 Debenedictis ..... H01R 4/2429 439/395
8,702,444 B2 4/2014 Maranto et al.
9,397,455 B2 7/2016 Fontaine et al.
9,413,125 B2 8/2016 Fontaine et al.

* cited by examiner

FIELD TERMINABLE TELECOMMUNICATIONS CONNECTOR

CROSS-REFERENCE TO RELATED APPLICATIONS

This application claims the benefit of U.S. provisional patent application Ser. No. 62/306,779 filed Mar. 11, 2016, the entire contents of which are incorporated herein by reference.

TECHNICAL FIELD

The subject matter disclosed herein relates generally to telecommunications connectors, and in particular to a field terminable telecommunications connector.

BACKGROUND

One type of existing telecommunications connector is referred to as field terminable. This means the installer connects wires to the connector at the job site or installation site. Many modular plugs require special field assembly techniques and expensive tools. Modular connectors that are more difficult to terminate may lead to improper terminations that result excess cost and loss of time during an installation as well as loss of network connectivity.

BRIEF DESCRIPTION OF THE DRAWINGS

Referring now to the drawings wherein like elements are numbered alike in the FIGURES.

DETAILED DESCRIPTION

Figure 1:
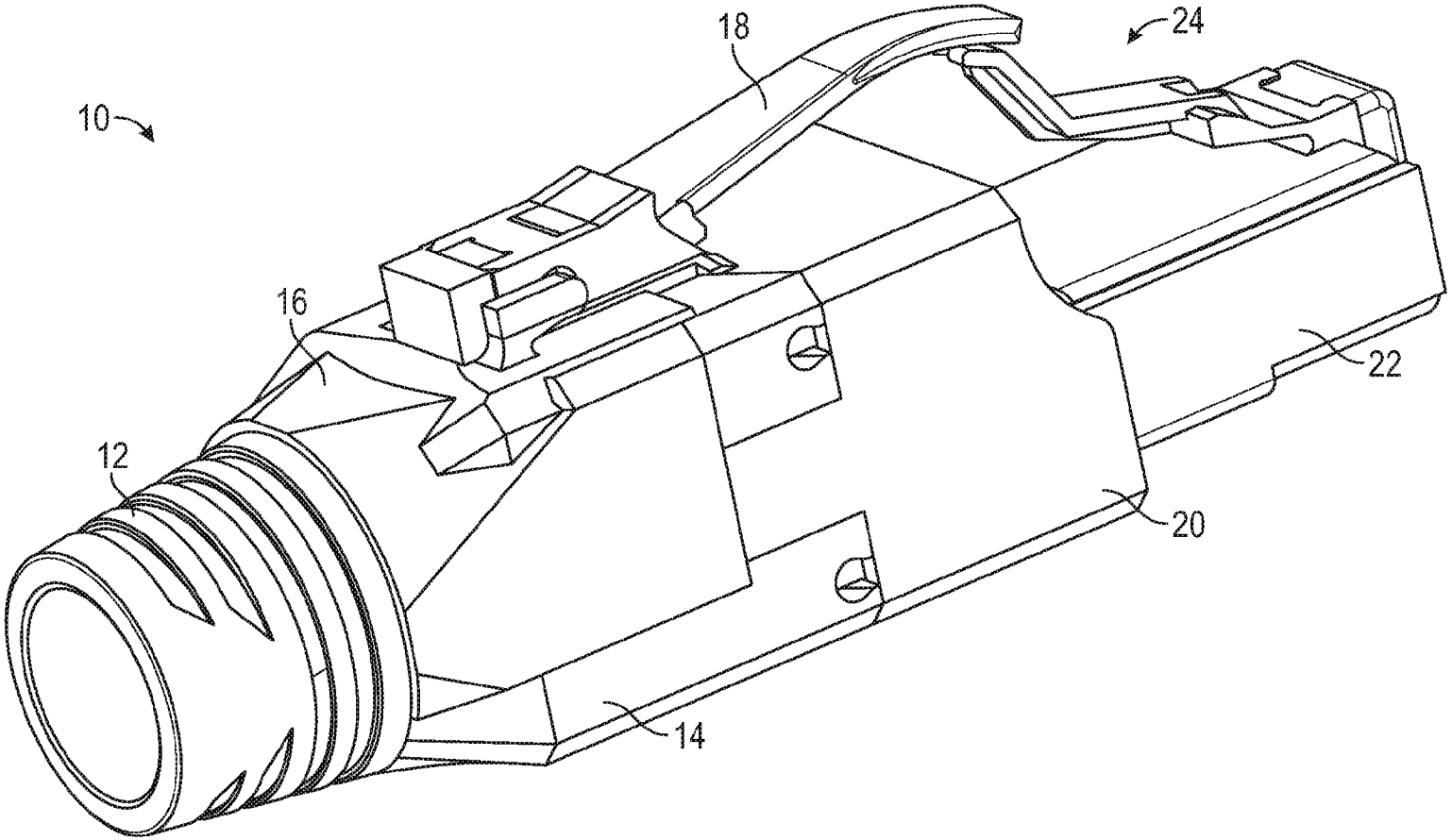
FIG. 1 is a perspective view of a telecommunications connector in an example embodiment.

FIG. 1 is a perspective view of a telecommunications connector 10 in an example embodiment. The telecommunications connector 10 is a plug, but it is understood that embodiments are not limited to plugs, but may include outlets, couplers, adapters, etc. The telecommunications connector 10 includes a boot 12, lacing cap subassembly 14, cover 16, latch actuator 18, shell 20, modular connector subassembly 22 and latch cover 24. Components of the telecommunications connector 10 are described in further detail herein.

Figure 2:
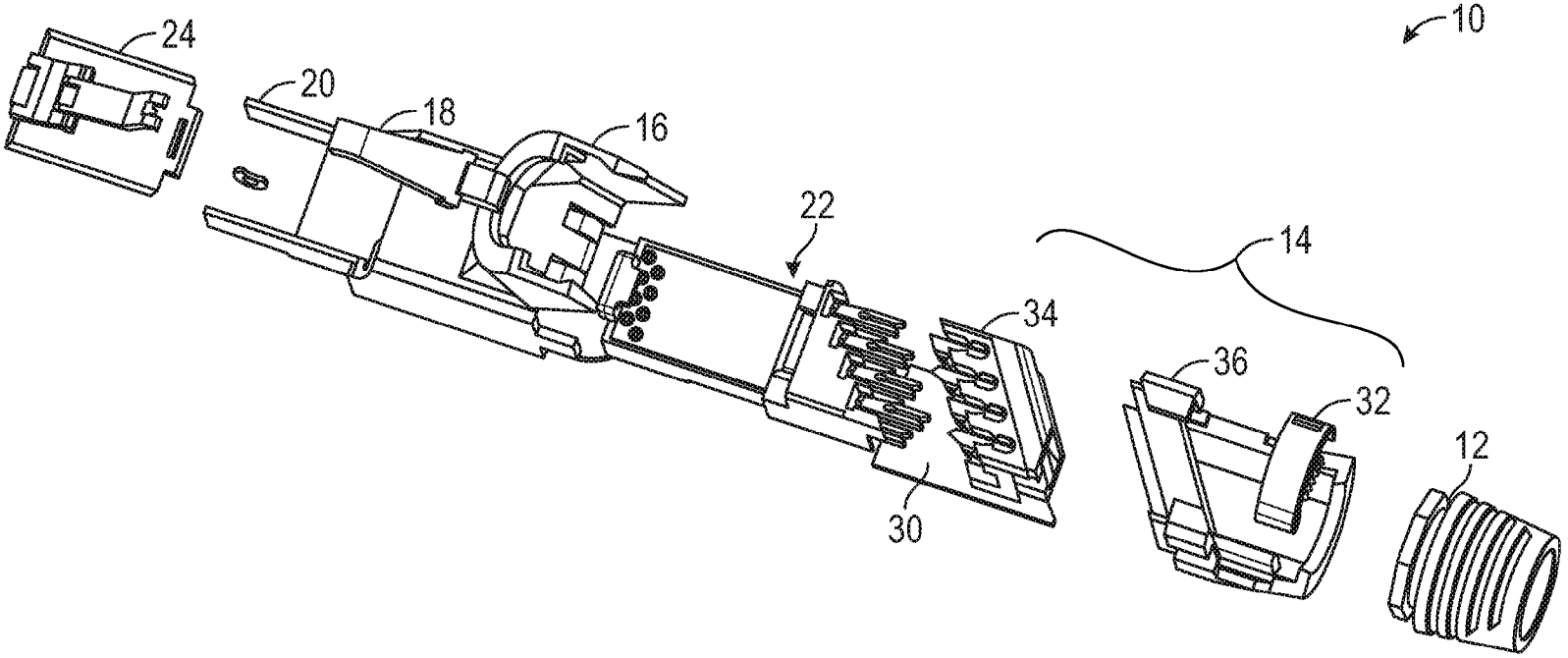
FIG. 2 is a perspective, exploded view of a telecommunications connector in an example embodiment.
Figure 3:
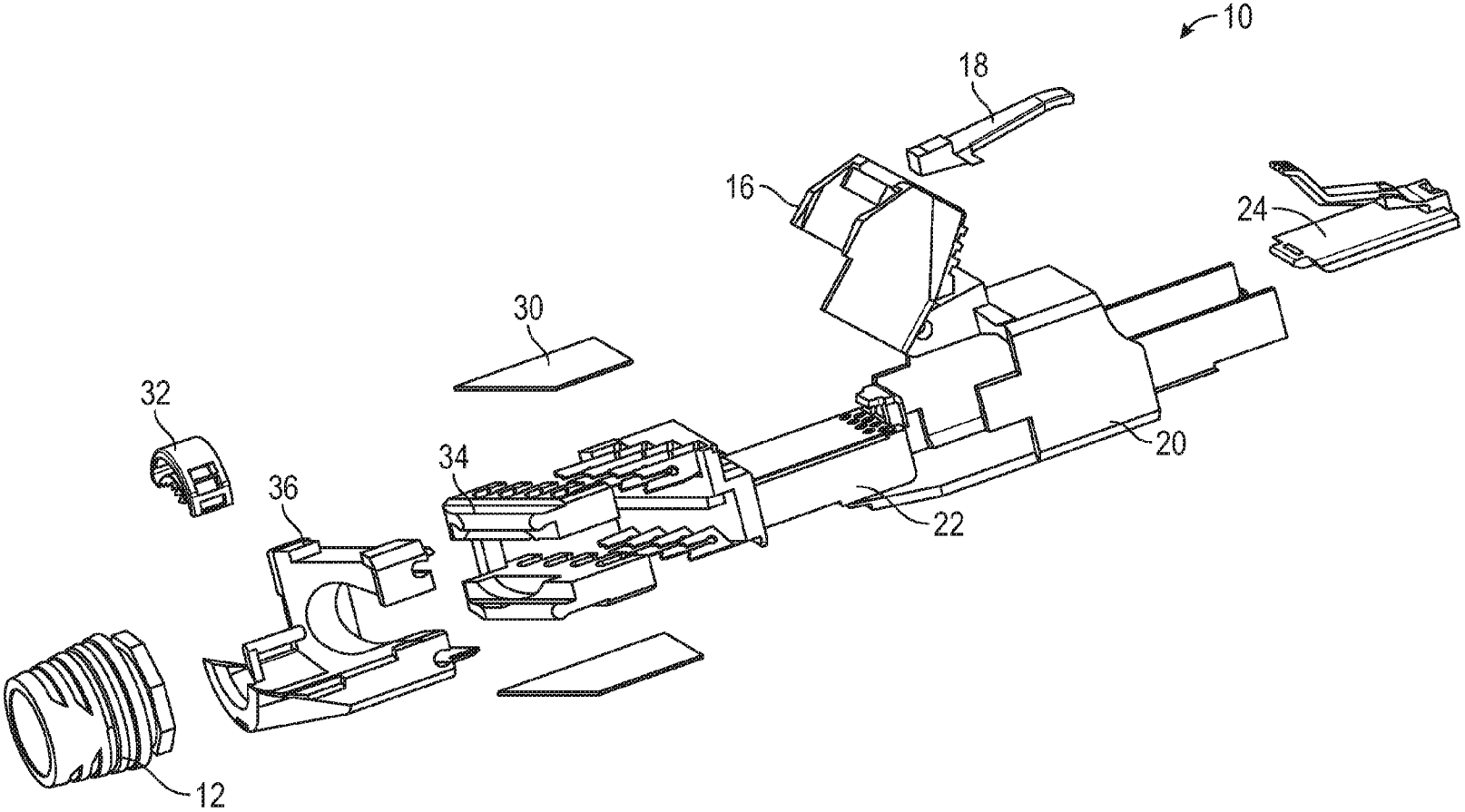
FIG. 3 is a perspective, exploded view of a telecommunications connector in an example embodiment.

FIGS. 2 and 3 are perspective, exploded views of telecommunications connector 10 in an example embodiment. Referring to FIGS. 2 and 3 collectively, the boot 12 is secured to the lacing cap subassembly 14 by the cover 16. The lacing cap subassembly 14 includes a lacing cap 34, strain relief body 36 and strain relief clip 32. One or more insulators 30 may be used to electrically isolate the wire termination contacts of the modular connector subassembly 22 from the shell 20, in embodiments where shell 20 is conductive (e.g., a shielded connector) or plastic (e.g., an unshielded connector). Cover 16 is pivotally connected to shell 20 and is rotated towards the lacing cap subassembly 14 during wire termination as disclosed in further detail herein. The latch cover 24 is secured to the shell 20 and provides a latch for mating with an outlet. Individual components and subassemblies are described in further detail herein with reference to FIGS. 4-14.

Figure 4:
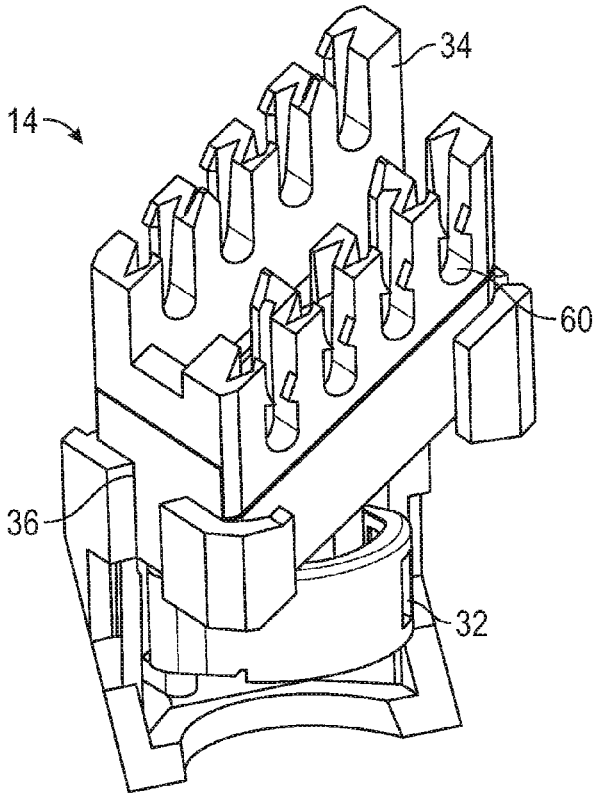
FIG. 4 is a perspective view of a lacing block subassembly in an example embodiment.
Figure 5:
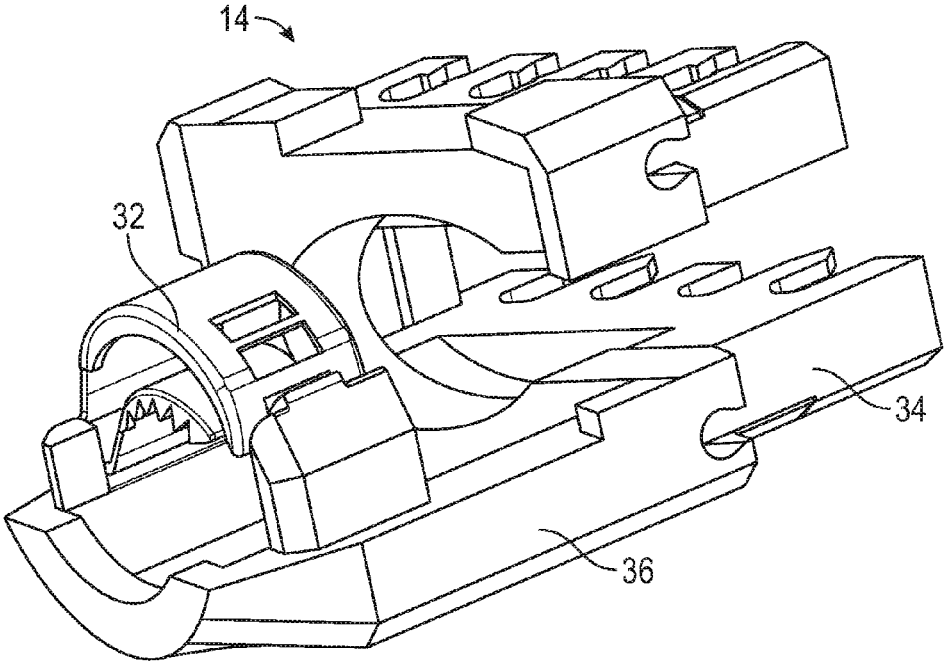
FIG. 5 is a perspective view of a lacing block subassembly in an example embodiment.

FIGS. 4 and 5 are perspective views of a lacing cap subassembly 14 in an example embodiment. The lacing cap subassembly 14 includes lacing cap 34, strain relief body 36 and strain relief clip 32. The lacing cap 34 may be secured to the strain relief body 36 using a snap in or slide in feature. The strain relief clip 32 is pivotally secured to the strain relief body 36 and is used to clamp onto a cable terminated to the telecommunications connector 10.

Figure 6:
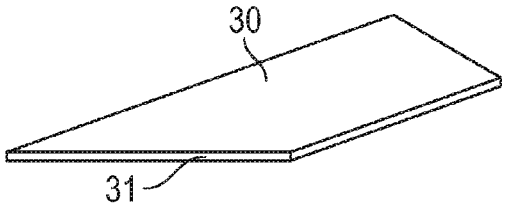
FIG. 6 is a perspective view of an insulator in an example embodiment.

FIG. 6 is a perspective view of an insulator 30 in an example embodiment. The insulator 30 may be made from a non-conductive plastic or non-conductive ceramic material to electrically isolate the wire contacts in the modular connector subassembly 22 from the conductive shell 20. The insulator may be generally rectangular, having one edge 31 arranged at an oblique angle. The oblique angle of edge 31 may match the angle of the wire receiving slots 60 (FIG. 4) of the lacing cap 34, as described in further detail herein. The edge 31 of the insulator may also be sharpened to allow the insulator to trim excess wire laced into the lacing cap 34.

Figure 7:
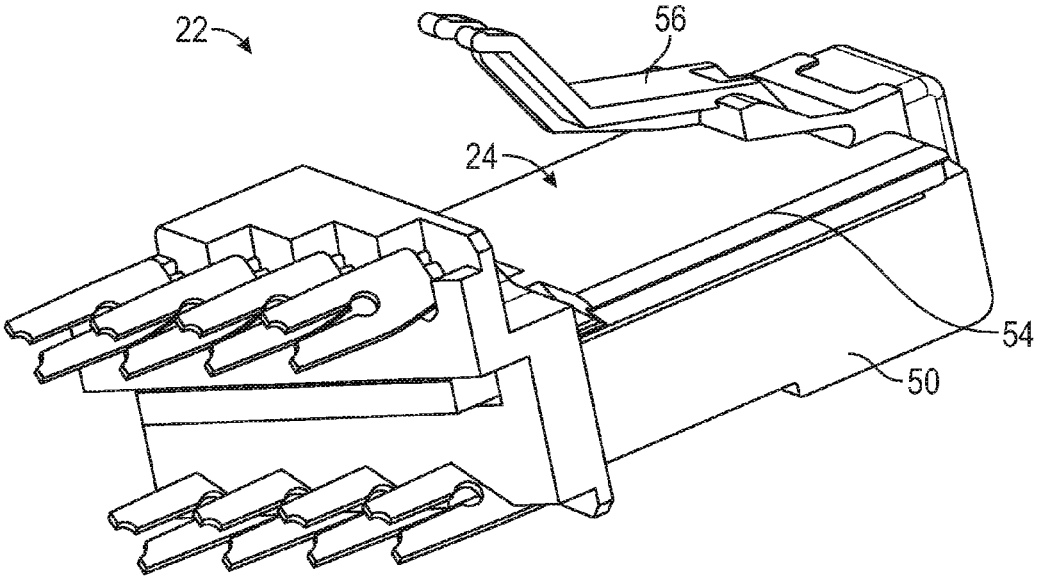
FIG. 7 is a perspective view of a modular connector subassembly in an example embodiment.
Figure 8:
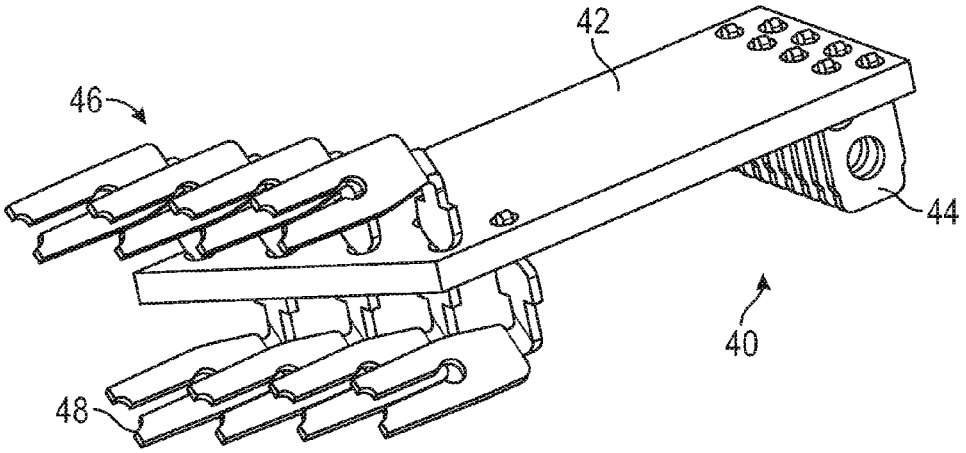
FIG. 8 is a perspective view of a substrate subassembly in an example embodiment.

FIG. 7 is a perspective view of a modular connector subassembly 22 in an example embodiment. The modular connector subassembly 22 includes a substrate assembly 40 (FIG. 8) including a substrate 42 (e.g., a printed circuit board), connector contacts 44 at a first end of the substrate 42 and wire contacts 46 at an opposite end of the substrate 42. The substrate 42 includes traces that electrically connect each of the wire contacts 46 to a respective one of the connector contacts 44. The wire contacts 46 may include insulation displacement contacts 48 that engage and make electrical contact with wires terminated to the connector 10. A first group of wire contacts 46 (e.g., four) are positioned on a first side of the substrate 42 and a second group of wire contacts 46 (e.g., four) are positioned on a second side of the substrate 42. Although eight wire contacts 46 are shown in FIG. 8, it is understood that any number of wire contacts 46 may be used.

Referring back to FIG. 7, the modular connector subassembly 22 includes a connector body 50 which supports the substrate assembly 40 and latch cover 24. The latch cover 24 includes a rectangular base 54 secure to the connector body 50 and a latch arm 56 that extends rearwards from a front portion of the connector body 50 to a rear portion of the connector body 50. The latch arm 56 is just one example of a latch, and other latch styles may be used in other embodiments.

Figure 9:
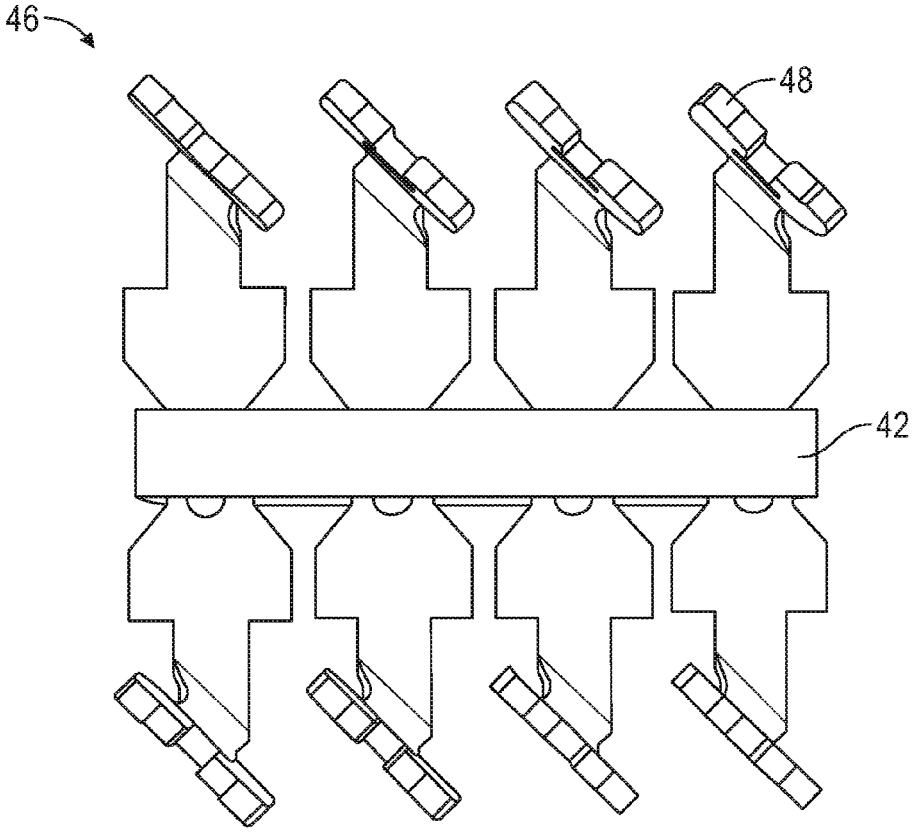
FIG. 9 is a rear view of wire contacts in an example embodiment.

FIG. 9 is a rear view of wire contacts 46 in an example embodiment. As shown in FIG. 9, the insulation displacement contacts 48 on the end of each wire contact 46 is arranged so that the plane of at least one insulation displacement contact 48 is non-parallel to the plane of the substrate 42. In the embodiment of FIG. 9, the plane of each insulation displacement contact 48 is non-parallel to the plane of the substrate 42. In an example embodiment, the plane of each insulation displacement contact 48 forms an acute angle with the plane of the substrate 42. This allows the insulation displacement contacts 48, and the wire contacts 46, to be placed closer together thereby reducing the footprint of the termination end of the connector 10.

Figure 10:
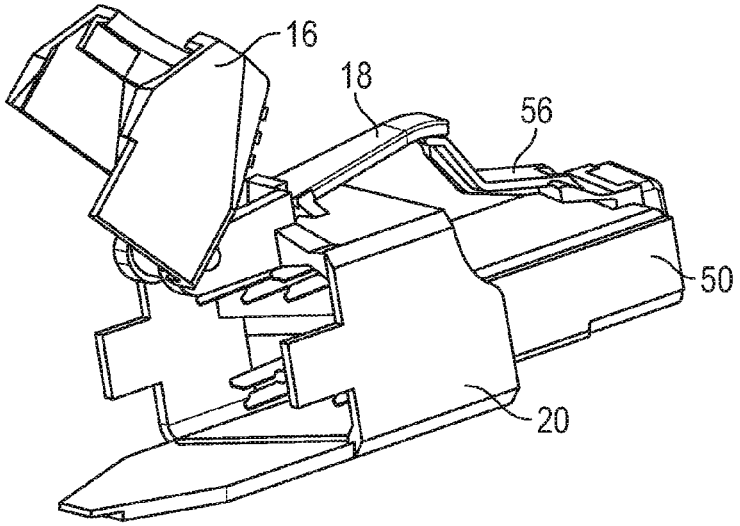
FIG. 10 is a perspective view of an outer shell, cover and modular connector body in an example embodiment.

FIG. 10 is a perspective view of the modular connector subassembly 22 mounted inside the outer shell 20. The cover 16 is pivotally mounted to the shell 20 and when closed, applies a termination force to the lacing cap subassembly 14 to drive the lacing cap 34 into the insulation displacement contacts 48. Latch actuator 18 is secured to the shell 200 and extends over a tip of latch arm 56. Applying downwards pressure to latch actuator 18 depresses latch arm 56 to disengage the connector 10 from an outlet or adapter. Latch actuator 18 also provide anti-snag features preventing the latch arm 56 from being caught on surfaces, cables, etc.

Figure 11:
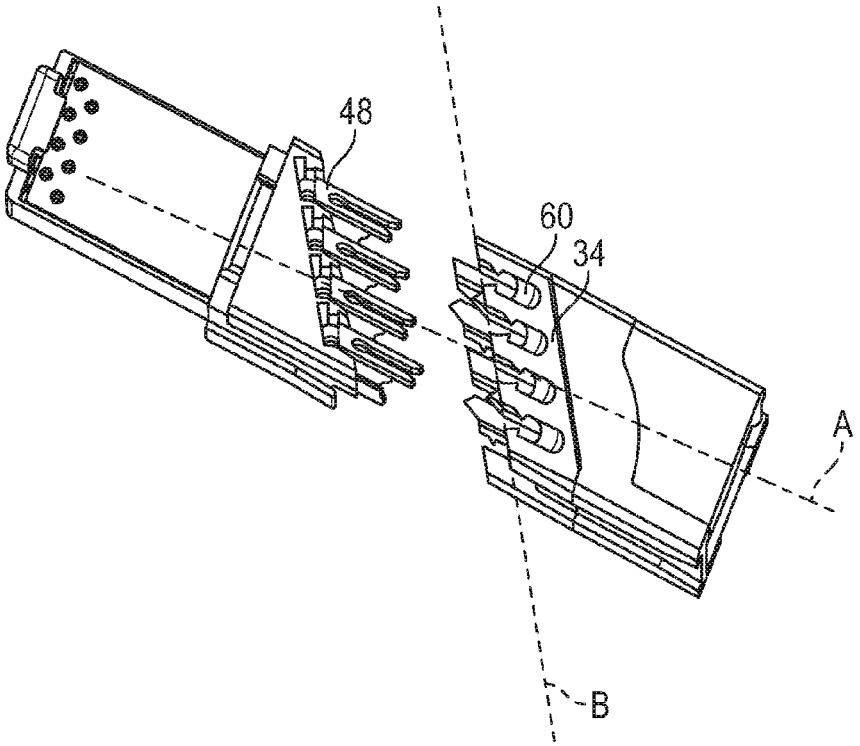
FIG. 11 is a perspective view of a lacing cap and wire contacts in an example embodiment.

FIG. 11 is a perspective view of a lacing cap 34 and insulation displacement contacts 48 in an example embodiment. The lacing cap 34 includes a plurality of wire receiving slots 60. When terminating the connector 10, individual wires are laced into each wire receiving slot 60. The lacing cap 34 is driven into the insulation displacement contacts 48 along a termination axis, A, which is parallel to a longitudinal axis of the connector 10. An axis, B, running through the bases of adjacent wire termination slots 60 is non-orthogonal to axis A. This reduces the width of the termination cap 34 and thus the overall footprint of the connector 10.

The depth of each wire receiving slot 60 may also vary relative to other wire receiving slots 60. In FIG. 11, the top row of wire receiving slots 60 may have a depth that is different (e.g., deeper) than the depth of the wire receiving slots 60 in the bottom row. This means that at any one time, only a subset of wires laced into the lacing cap 34 are engaging a respective insulation displacement contact 48. Thus reduces the force needed to termination the wires into the insulation displacement contacts 48 and facilitates field termination.

Figure 12:
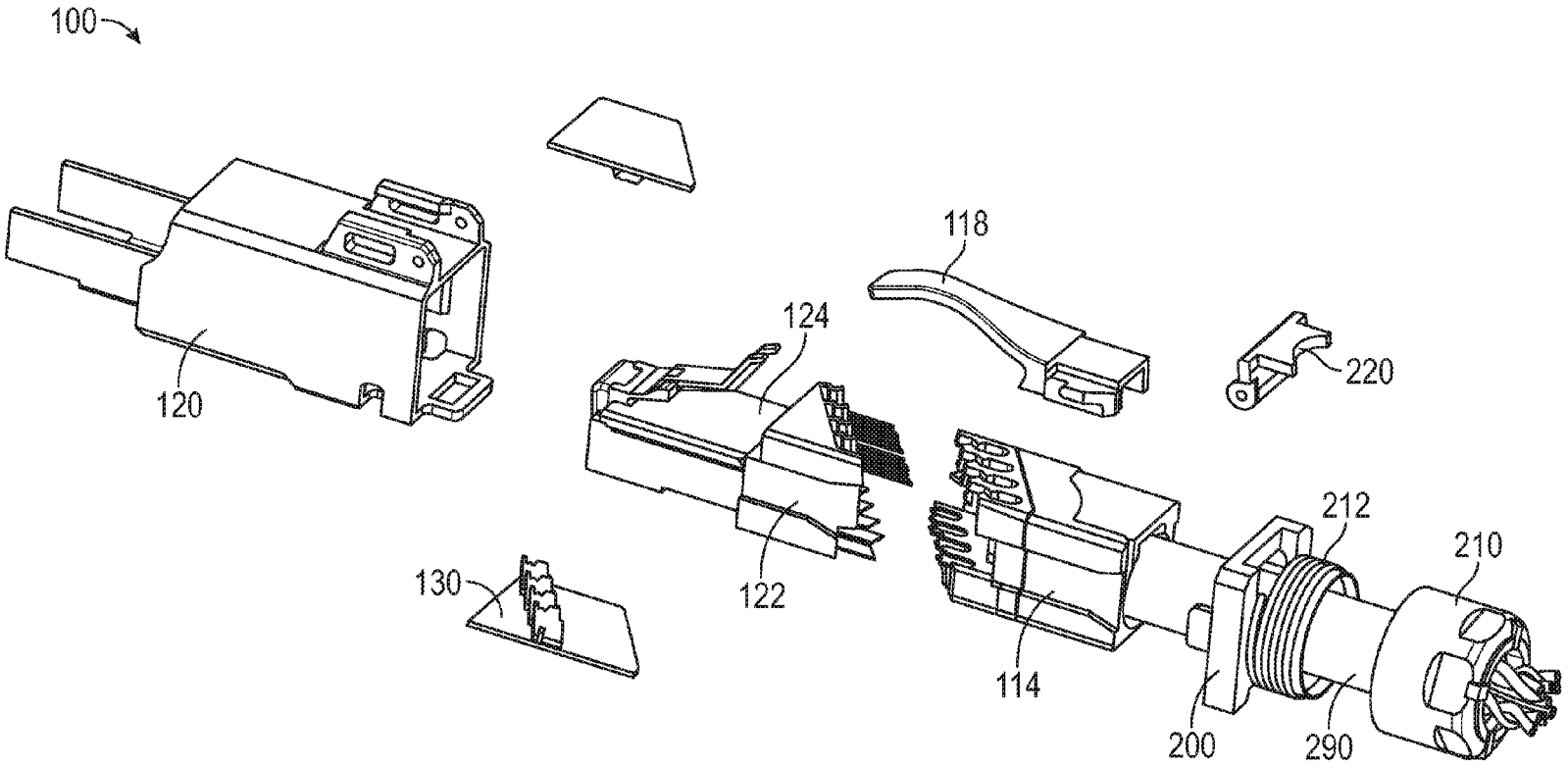
FIG. 12 is a perspective, exploded view of a telecommunications connector in example embodiment.

FIG. 12 is a perspective, exploded view of a telecommunications connector 100 in another example embodiment. The embodiment of FIG. 12 includes a different stain relief including a lockable boot 200. Connector 100 includes a shell 120 similar to shell 20. Insulators 130 are similar to insulators 30. A modular connector subassembly 122 receives a latch cover 124. Latch actuator 118 is secured to shell 120 and extends over the latch of latch cover 124. A lacing cap subassembly 114 is similar to 14, but has a planar back end that receives a lockable boot 200. One side of the lockable boot 200 snaps onto the rear of the shell 120. A boot latch 220 is pivotally secured to shell 120, and rotates downwards to lock lockable boot 200 to the shell 120. Lockable boot 200 includes a threaded compression section 212. A strain relief cap 210 around cable 290 is threaded on the threaded compression section 212 to clamp onto cable 290.

Figure 13:
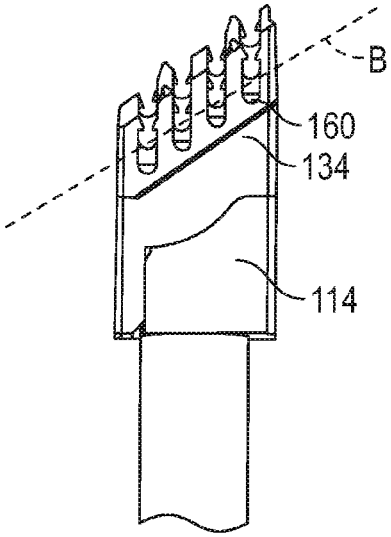
FIG. 13 is a top view of a lacing cap subassembly and modular connector subassembly in an example embodiment.

FIG. 13 depicts lacing cap subassembly 114 and modular connector subassembly 122 in an example embodiment. Lacing cap 134 includes wire receiving slots 160 similar to wire receiving slots 60 described above. The lacing cap 134 is driven into the insulation displacement contacts 148 of wire contacts 146 along a termination axis, A, which is parallel to a longitudinal axis of the connector 100. An axis, B, running through the bases of adjacent wire termination slots 160 is non-orthogonal to axis A. FIG. 13 also depicts the tails 149 of the wire contacts 146. Tails 149 are press fit into substrate 142. Each tail has a planar body, and the planar tails 149 are arranged along a common, linear axis, C. In example embodiments, axis C is parallel to axis B. Aligning the tails 149 in a common plane facilitates installation of the wire contacts 146 into the substrate 142. The row of wire contacts on the opposite side of substrate 142 may have similar tails arranged along a common axis in a single plane.

Figure 14:
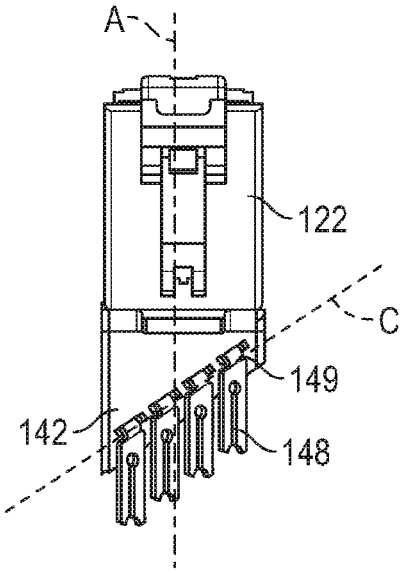
FIG. 14 is a side view of a lacing cap in an example embodiment.
Figure 14:
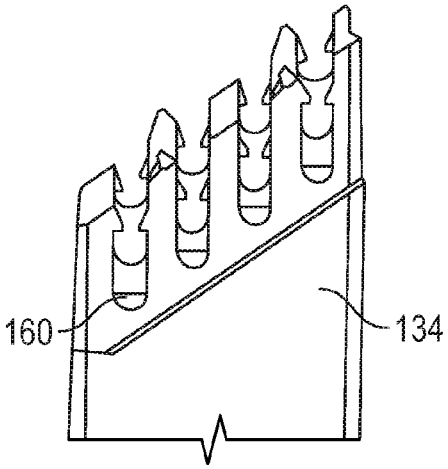

FIG. 14 is a side view of a lacing cap 134 in an example embodiment. The depth of each wire receiving slot 160 may also vary relative to other wire receiving slots 160. In FIG. 14, the top row of wire receiving slots 160 may have a depth that is different (e.g., deeper) than the depth of the wire receiving slots 160 in the bottom row. This means that at any one time, only a subset of wires laced into the lacing cap 134 are engaging a respective insulation displacement contact 148. Thus reduces the force needed to termination the wires into the insulation displacement contacts 148 and facilities field termination.

Figure 15:
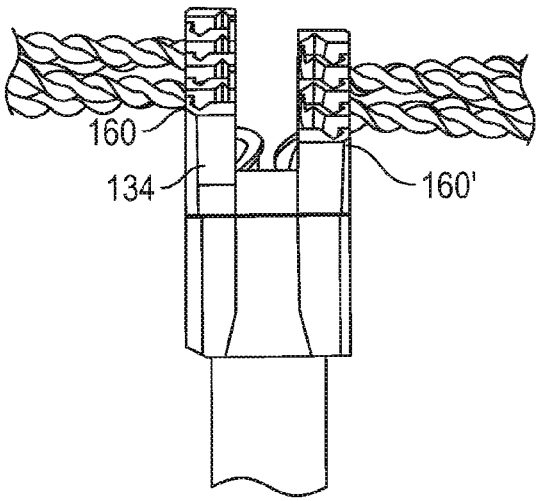
FIG. 15 is a side view of the lacing cap with wires in an example embodiment.

FIG. 15 is a side view of the lacing cap with wires in an example embodiment. Evident in FIG. 15 are the different depths of the wire receiving slots 160 in each row of wire receiving slots, such that wire receiving slots 160' are deeper than wire receiving slots 160.

Embodiments uses unique geometry and design elements that allow for easier and faster installation times of modular connectors to communication cables. As communication application speeds and bandwidth increase there is the need for larger cable conductors to transmit signals. The larger conductors have a larger cable diameter and require more room for termination and, therefore, there is less room for lacing the wires into a lacing cap subassembly 14/114 or connector. Embodiments allow for the termination of cables with larger conductors. By lacing the wires into a lacing cap subassembly 14/114 that has wire receiving slots 60/160 at an angle, there is additional room for the conductors.

Another feature is the depth of the wire receiving slots 60/160 in the lacing cap subassembly 14/114. The wire receiving slots 60/160 can have slightly different depths which allows the termination force for the assembly to be reduced because the conductors are presented to the mating insulation displacement contacts 48/148 at slightly different times thus staggering the time when the peak load for each contact is achieved. The result is the reduction of the total termination force.

Another benefit of the lacing cap subassembly 14/114 is the position of the laced conductors in the lacing cap subassembly 14/114 prior to cutting of the excess conductors. The conductors are easily laced into the lacing cap subassembly 14/114 as shown in FIG. 15 and can be pulled tightly into the wire receiving slots 60/160. The excess conductors need to be trimmed flush to the lacing cap subassembly 14/114 to prevent the conductors from shorting to each other and, if the conductors are left long after trimming, this excess length will increase the termination force due to the interference of the excess conductors and the mating modular plug outer shell. The insulators 30/130 may incorporate blades to cut the excess conductors and this further reduces the modular plug assembly time.

In addition, the insulation displacement contacts 48/148 are located on an angle and this angle provides for greater separation and isolation of the insulation displacement contacts 48/148. This separation and isolation of the insulation displacement contacts 48/148 allows for improved transmission performance of the connector with respect to typical transmission properties of the connector. The angle of the base 149 of the insulation displacement contacts 148 can also be aligned in the same plane to improve the assembly process.

Embodiments allow for faster termination time which allows for installations that are more cost effective because the cable can be laid into the lacing cap subassembly 14/114.

Figure 16:
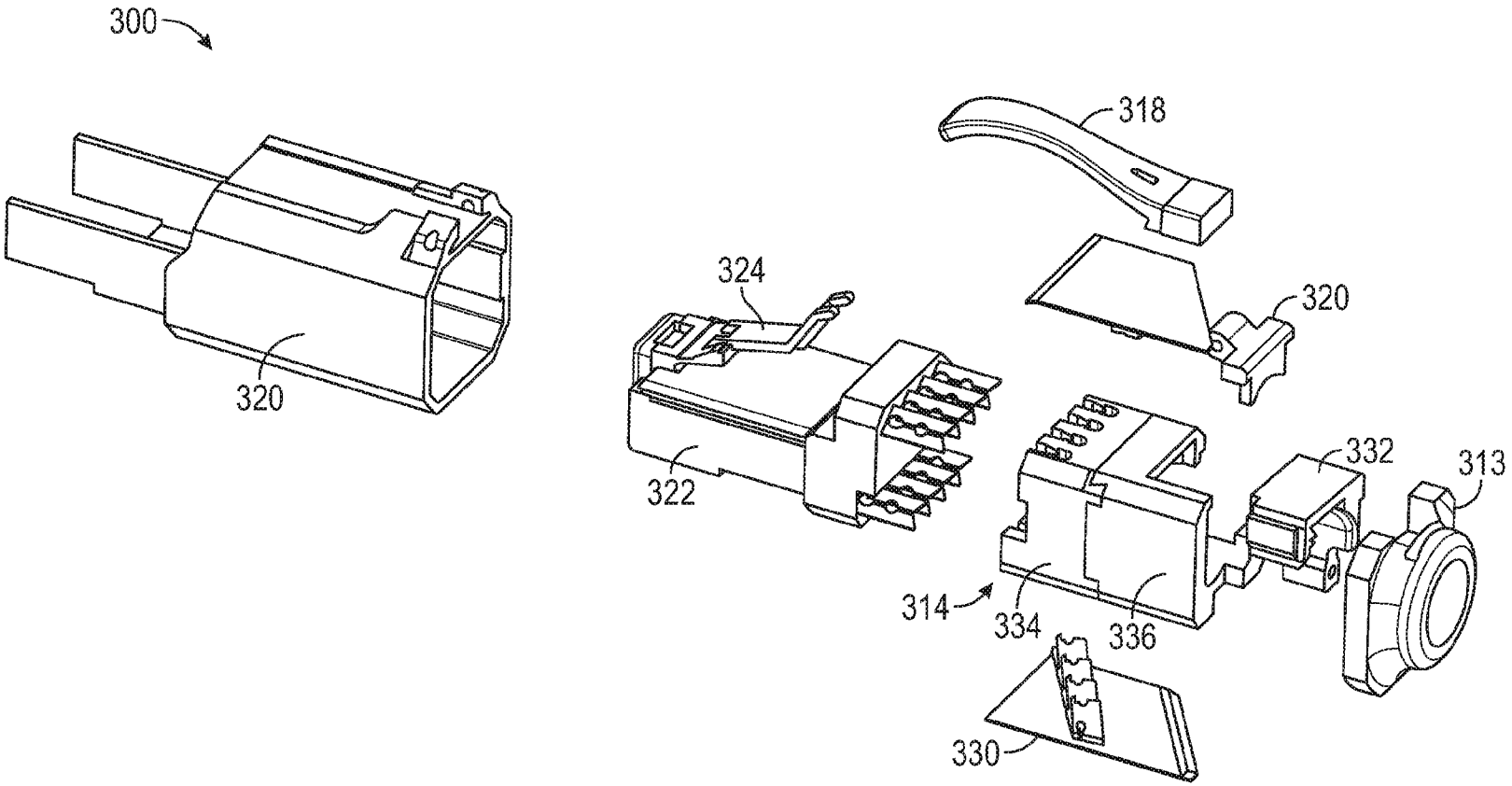
FIG. 16 is a perspective, exploded view of a telecommunications connector in example embodiment.

FIG. 16 is a perspective, exploded view of a telecommunications connector 300 in another example embodiment. The embodiment of FIG. 16 includes a different lacing cap subassembly 314. Connector 300 includes a shell 320 similar to shell 120. Insulators 330 are similar to insulators 130. A modular connector subassembly 322 receives a latch cover 324. The modular connector subassembly 322 may be similar to modular connector subassembly 22, and have an RJ45 form factor. Latch actuator 318 is secured to shell 320 and extends over the latch of latch cover 324. A lacing cap subassembly 314 includes a lacing cap 334, lacing cap body 336 and lacing cap door 332. Lockable boot 313 snaps onto the rear of lacing cap subassembly 314. A boot latch 320 is pivotally secured to shell 320, and rotates downwards to lock lockable boot 313 to lacing cap subassembly 314.

Figure 23:
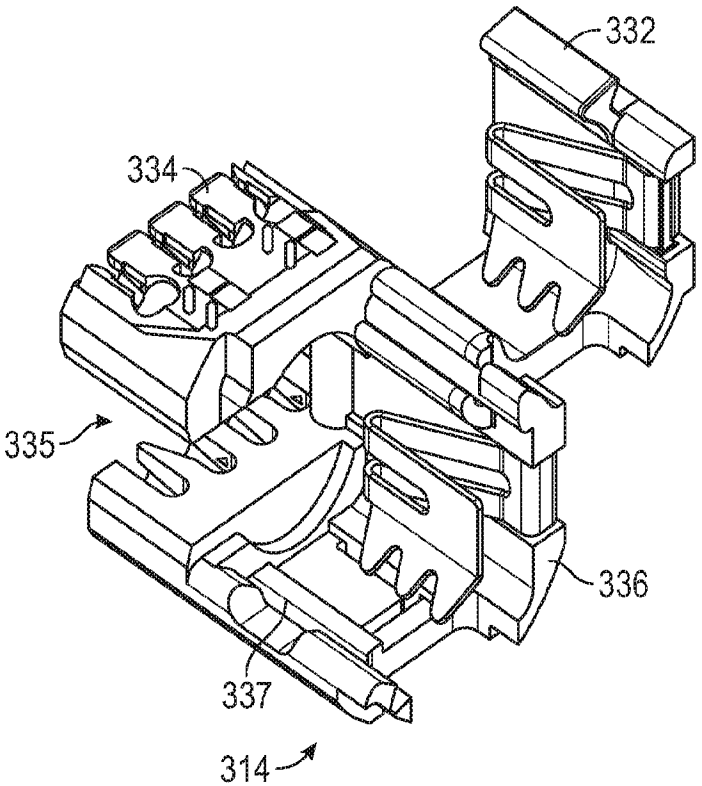
FIG. 23 is a perspective view of a lacing cap subassembly in an example embodiment.

The lacing cap 334 and lacing cap body 336 are generally rectangular and include an opening in at least one side wall to allow the cable 290 to be placed in the lacing cap subassembly 314. As shown in FIG. 23, the lacing cap 334 has an opening 335 in a side wall and the lacing cap body 336 has an opening 337 in a sidewall that is adjacent to and aligned with opening 335. Openings 335 and 337 are sized to accept cable 290. This allows cable 290 to be placed in the lacing cap subassembly 314 when lacing cap door 332 is in an open position. The lacing cap door 332 is then closed to provide strain relief to cable 290 by applying a clamping pressure to the outside of cable 290. This facilitates field termination of the connector 300 by eliminating the need to thread the cable though a narrow opening.

Figure 18:
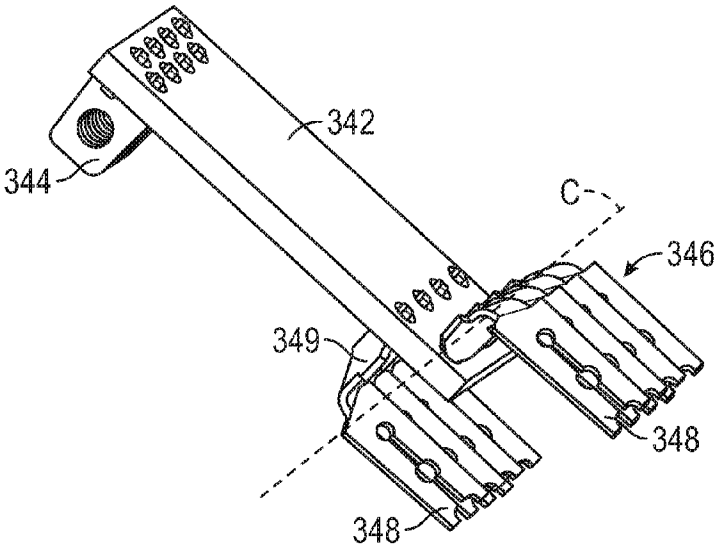
FIG. 18 is a perspective view of a substrate subassembly in an example embodiment.
Figure 17:
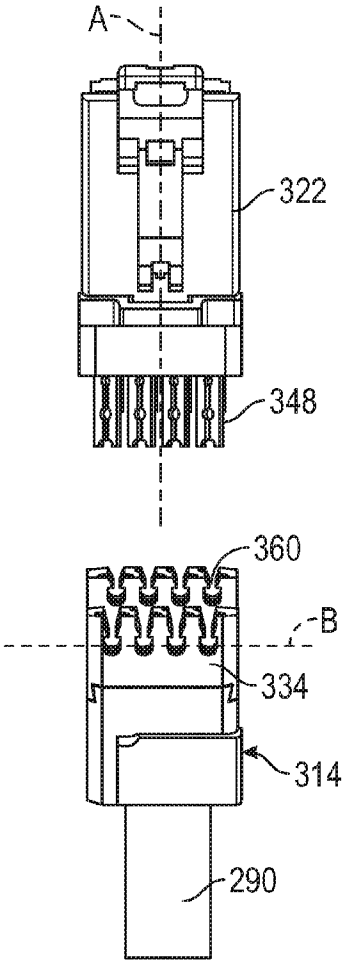
FIG. 17 is a top view of a lacing cap subassembly and modular connector subassembly in an example embodiment.

FIG. 17 is a top view of a lacing cap subassembly 314 and modular connector subassembly 322 in an example embodiment. Lacing cap 334 includes wire receiving slots 360 similar to wire receiving slots 60 described above. The lacing cap 334 is driven into the insulation displacement contacts 348 of wire contacts 346 (FIG. 18) along a termination axis, A, which is parallel to a longitudinal axis of the connector 300. An axis, B, running through the bases of adjacent wire termination slots 360 is orthogonal to axis A. FIG. 18 also depicts the tails 349 of the wire contacts 346. Tails 349 are press fit into substrate 342. Each tail has a planar body, and the planar tails 349 are arranged along a common, linear axis, C. In example embodiments, axis C is parallel to axis B. Aligning the tails 349 in a common plane facilitates installation of the wire contacts 346 into the substrate 342. The row of wire contacts on the opposite side of substrate 342 may have similar tails arranged along a common axis in a single plane. FIG. 18 depicts connector contacts 344, which are similar to connector contacts 44.

Figure 19:
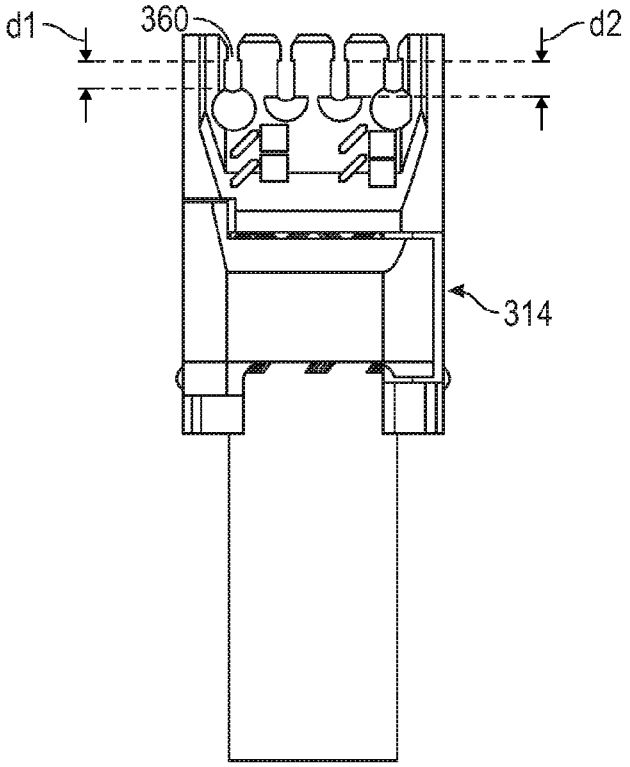
FIG. 19 is a top view of a lacing cap subassembly in an example embodiment.

FIG. 19 is a top view of a lacing cap subassembly 314 in an example embodiment. The wire receiving slots 360 may be arrange to have differing depths. As shown in FIG. 19, the wire receiving slots 360 have depths of d1 or d2, where d2 is greater than d1. The wire receiving slots 360 having different depths allows the termination force for the assembly to be reduced because the conductors are presented to the mating insulation displacement contacts (IDC) 348 at slightly different times thus staggering the time when the peak load for each wire contact 346 is achieved. The result is the reduction of the total termination force. The insulation displacement contacts 348 of the wire contacts 346 extend from the substrate 342 by different lengths (FIG. 18) to accommodate the different depths of the wire receiving slots 360. In one embodiment, the insulation displacement contacts 348 of the wire contacts 346 on a first side of substrate 342 extend farther (e.g., for depth d2) than the insulation displacement contacts 348 of the wire contacts 346 on a second side of substrate 342.

Figure 20:
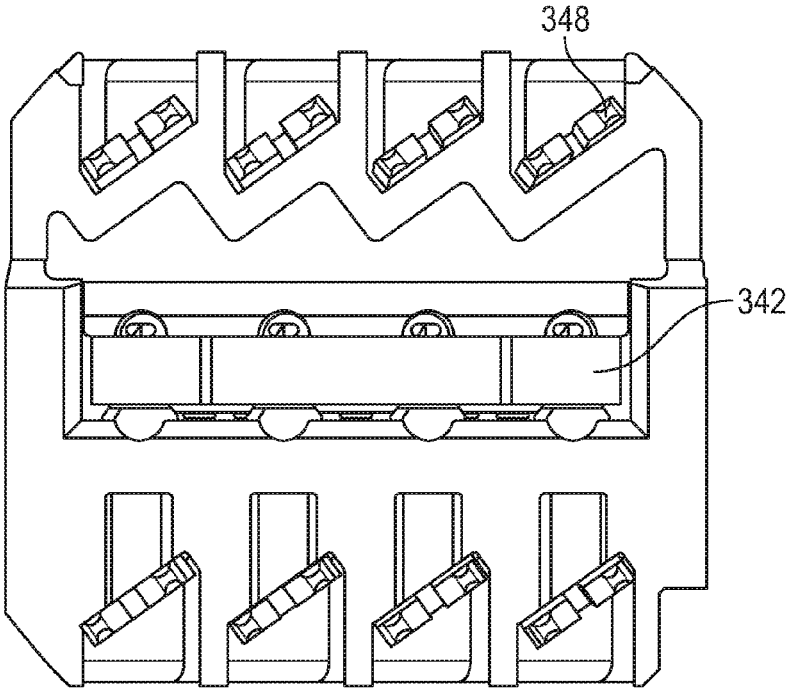
FIG. 20 is an end view of the modular connector subassembly in an example embodiment.

FIG. 20 is a rear view of a wire contacts 346 in an example embodiment. As shown in FIG. 20, the insulation displacement contacts 348 on the end of each wire contact 346 is arranged so that the plane of at least one insulation displacement contact 348 is non-parallel to the plane of the substrate 342. In the embodiment of FIG. 20, the plane of each insulation displacement contact 348 is non-parallel to the plane of the substrate 342. In an example embodiment, the plane of each insulation displacement contact 348 forms an acute angle with the plane of the substrate 342. This allows the insulation displacement contacts 348, and the wire contacts 346, to be placed closer together thereby reducing the footprint of the termination end of the connector 300.

Figure 21:
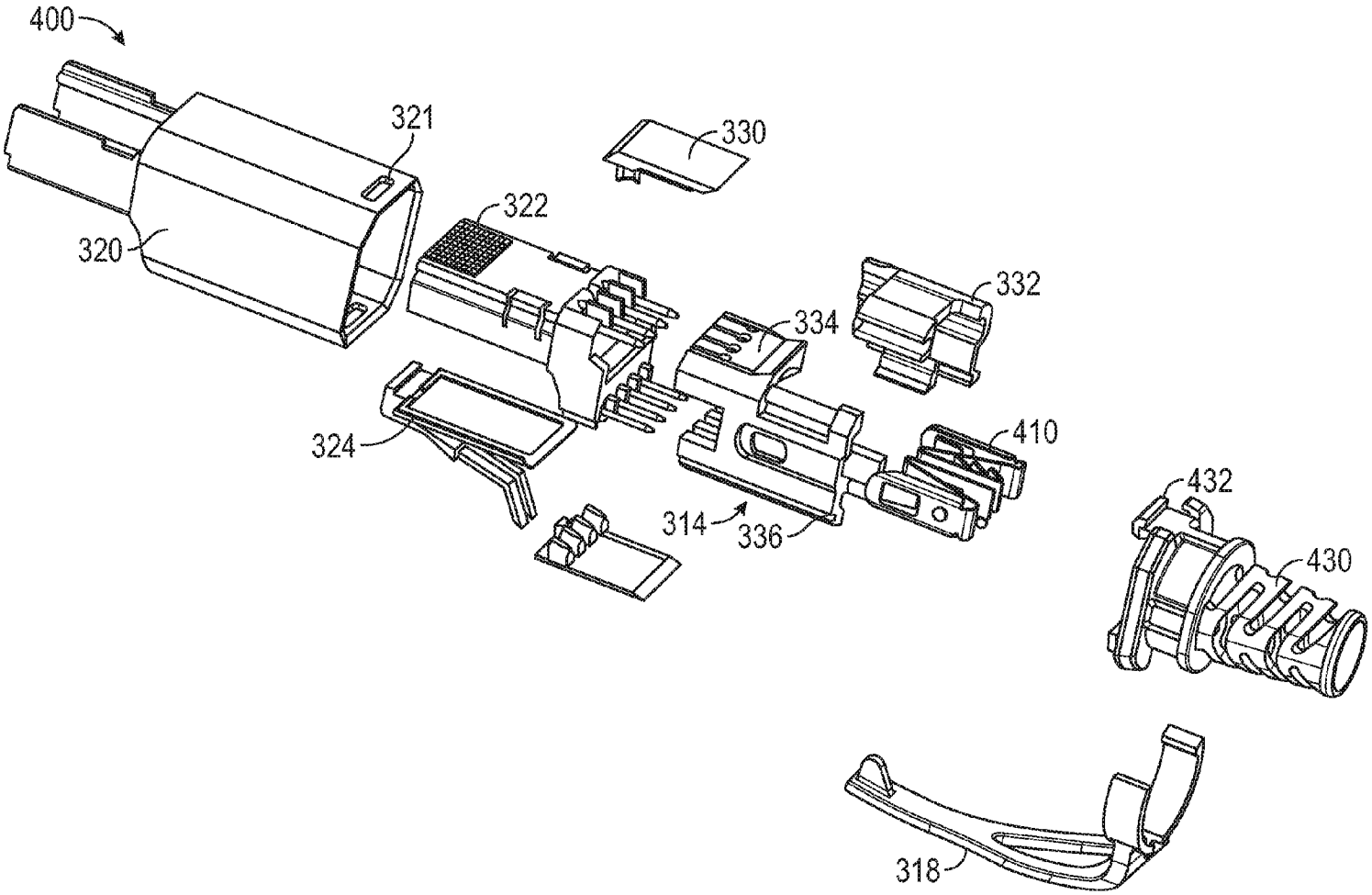
FIG. 21 is a perspective, exploded view of a telecommunications connector in an example embodiment.

FIG. 21 is a perspective, exploded view of a telecommunications connector 400 in another example embodiment. Connector 400 includes many of the components of connector 300, which are labeled with the identical reference number. Connector 400 includes a snap-on boot 430 having tabs 432 that are received in slots 321 on shell 320. The boot 430 is reversible meaning it can be attached to shell 320 in multiple orientations.

Connector 400 also includes clips 410 that are installed into the lacing cap subassembly 314. Clips 410 may provide multiple functions including strain relief of cable 290 and/or a ground path from a shield of cable 290 to shell 320 in embodiments where the shell 320 is conductive (e.g., shielded solutions).

Figure 22:
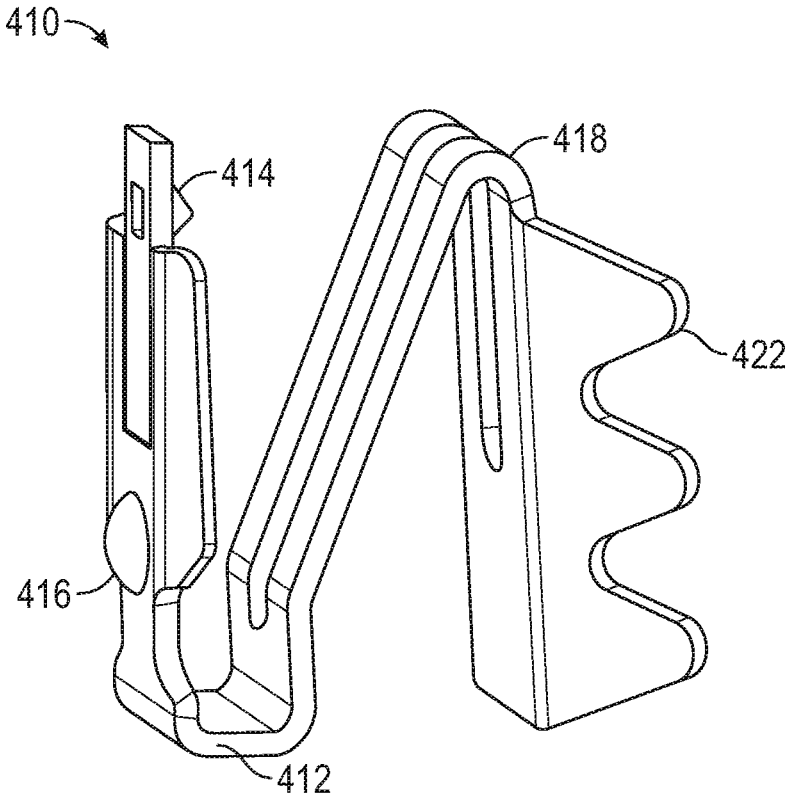
FIG. 22 depicts a clip in an example embodiment.

FIG. 22 depicts a clip 410 in an example embodiment. Clip 410 includes a generally u-shaped coupling section 412 that receives an edge of either the lacing cap door 332 or the lacing cap body 336. A barb 414 extends inwards from the coupling section 412 and secures the clip 410 to the lacing cap door 332 or the lacing cap body 336. A bump 416 is formed on an outer surface of the coupling section 412. When the lacing cap subassembly 314 is mated with shell 320, bump 416 engages shell 320 to provide a mechanical and electrical connection between the clip 410 and the shell 320.

Clip 410 also includes a biasing section 418 which may be a u-shaped, resilient section. Coupled to the biasing section 418 are one or more barbs 422. The barbs 422 contact the cable 290 and provide strain relief. In shielded versions, the barbs 422 also make electrical contact with the ground screen of cable 290, as described in further detail herein.

Figure 24:
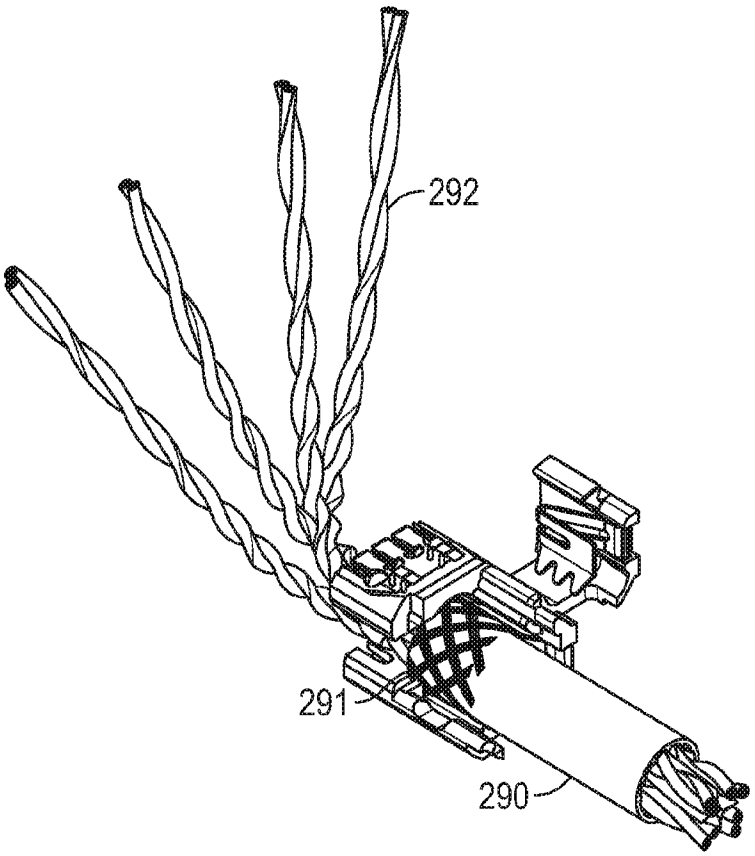
FIG. 24 is a perspective view of a cable positioned in a lacing cap subassembly in an example embodiment.

Termination of a cable 290 to connector 400 is described with reference to FIG. 23 to FIG. 28. FIG. 23 is a perspective view of a lacing cap subassembly 314 in an example embodiment. Lacing cap door 332 is in an open position. As shown in FIG. 24, cable 290 is laid into the lacing cap subassembly 314. A ground screen 291 of the cable 290 is peeled back and located within the lacing cap body 336. The internal wire conductors 292 of the cable extend beyond the lacing cap 334. Cable 290 in FIG. 24 includes eight conductors, arranged in four tip-ring twisted pairs. It is understood that connector 400 may be used with other types of cable, and is not limited to eight wires. As described above, the openings 335 and 337 in the lacing cap subassembly 314 facilitate positioning the cable 290 in the lacing cap subassembly 314.

Figure 26:
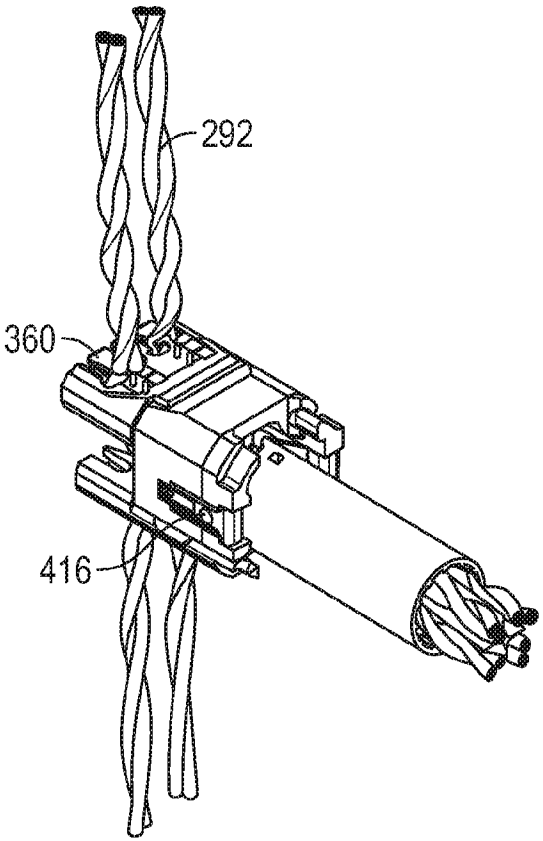
FIG. 26 is a perspective view of a cable positioned in a lacing cap subassembly in an example embodiment.
Figure 25:
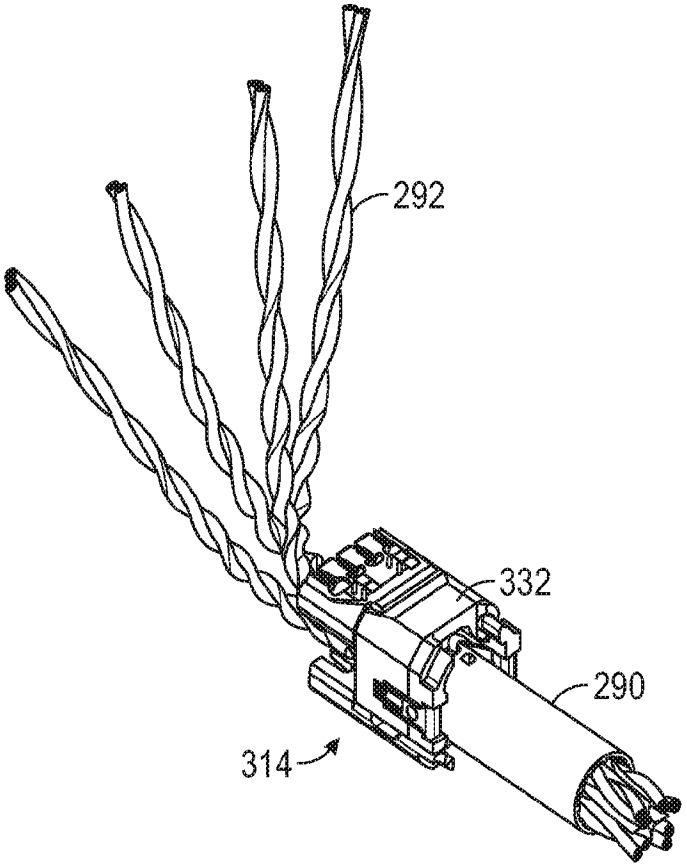
FIG. 25 is a perspective view of a cable positioned in a lacing cap subassembly in an example embodiment.

FIG. 25 is a perspective view of cable 290 positioned in a lacing cap subassembly 314, with the lacing cap door 332 in a closed position. As shown in FIG. 26, the individual wires of the cable may then be placed into the wire receiving slots 360 of the lacing cap 334. Wires 292 may then be trimmed to be flush with the lacing cap 334. Visible in FIG. 26 is bump 416 on clip 410. The lacing cap subassembly 314 may then be terminated to the modular connector subassembly 322. This performed using a tool to press the lacing cap subassembly 314 into the modular connector subassembly 322 so that wires 292 engage the insulation displacement contacts 348 and make an electrical connection.

Figure 27:
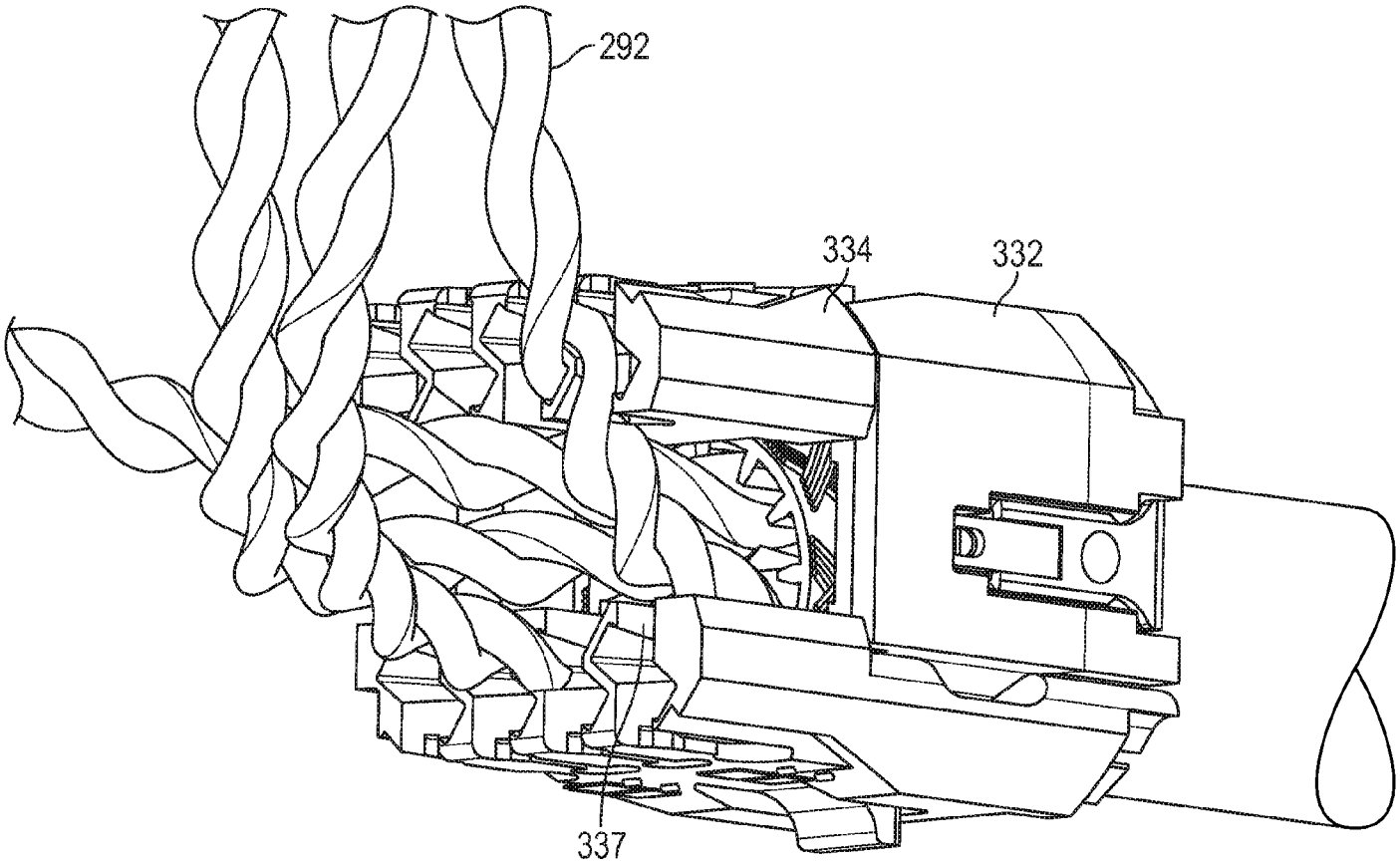
FIG. 27 is a perspective view of a cable positioned in a lacing cap subassembly in an example embodiment.

FIG. 27 is a perspective view of cable 290 positioned in a lacing cap subassembly 314. The wires 292 are laced into wire receiving slots 360 with the aid of a pair separator 337, which may be located between pairs of wire receiving slots 360. Wires 292 in cable 290 are arranged in twisted pairs. The pair separator 337 includes a wedged surface that facilities separation of the twisted pair of wires 292 to enter wire receiving slots 360.

Figure 28:
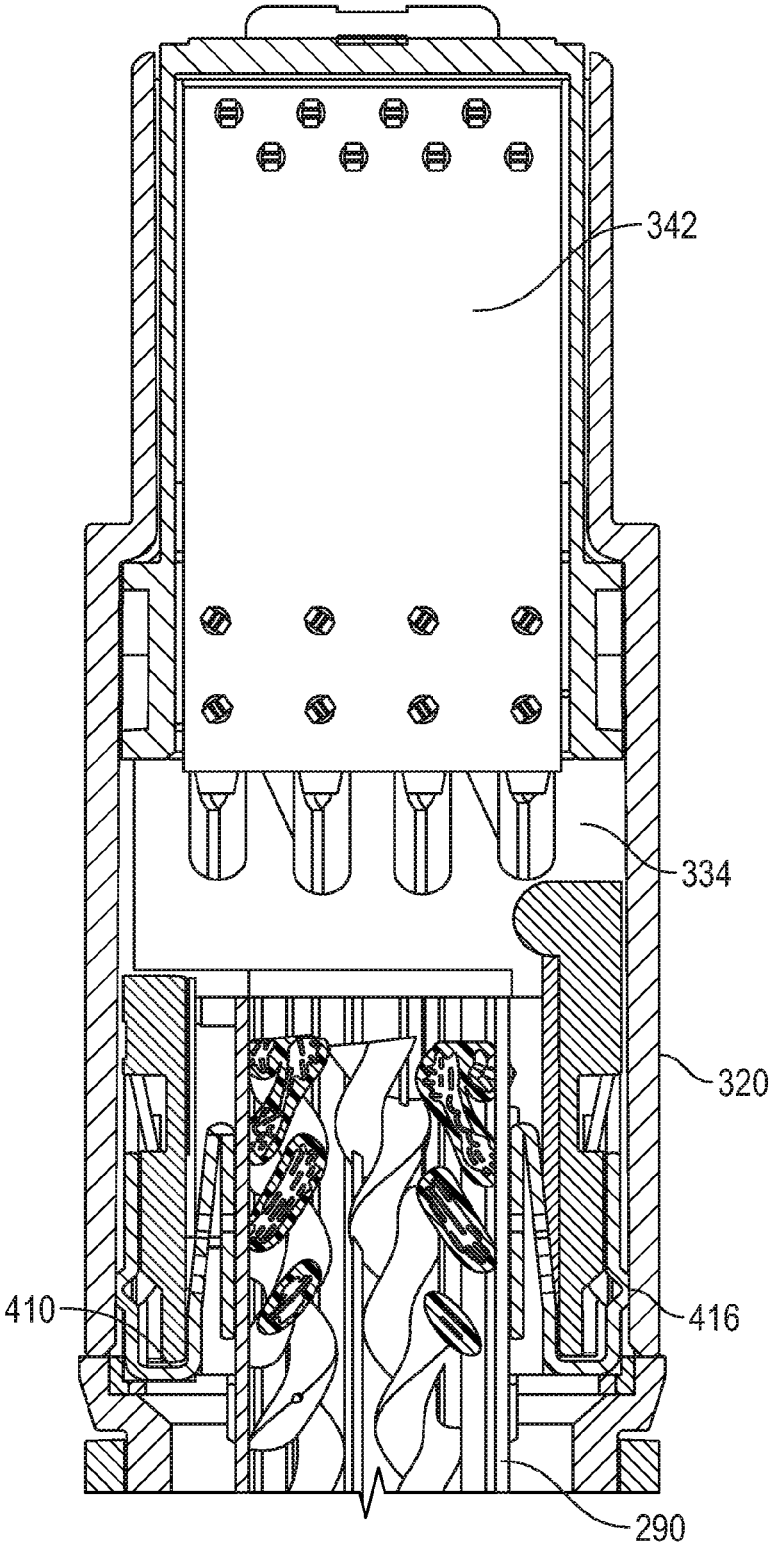
FIG. 28 is a cross sectional view of a lacing cap subassembly mated with a modular connector subassembly in an example embodiment.

FIG. 28 is a cross-sectional view of a lacing cap subassembly 314 mated with a modular connector subassembly 322 in an example embodiment. The bump 416 of clip 410 is wedged against the interior sidewall of shell 320. Barbs 422 on clips 410 contact the ground screen of cable 290, to provide a ground path from the cable 290 to the shell 320. Barbs 422 also provide strain relief to cable 290 by making physical contact with the cable jacket.

As many who are well versed in the application, the modular plug may also be replaced by a modular jack, outlet or other similar type connector.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while the various embodiments of the invention have been described, it is to be understood that aspects of the invention may include only some of the described embodiments. Accordingly, the invention is not to be seen as being limited by the foregoing description.

What is claimed is:

1. A connector comprising:

a modular connector subassembly including:

a connector body;

a substrate positioned in the connector body;

wire contacts electrically coupled to the substrate;

connector contacts electrically coupled to the substrate;

the substrate including traces that electrically connect each of the wire contacts to a respective one of the connector contacts;

a lacing cap subassembly including:

a lacing cap having a plurality of wire receiving slots;

a lacing cap body coupled to the lacing cap;

a lacing cap door hingedly coupled to the lacing cap body, the lacing cap door moveable between an open and closed position.

2. The connector of claim 1 wherein:

the lacing cap includes a first opening in a sidewall thereof sized to receive a cable; and the lacing cap body includes a second opening in a sidewall thereof sized to receive the cable;

the first opening positioned adjacent to the second opening.

3. The connector of claim 2 wherein:

the lacing cap door allows and prevents access through the second opening.

4. The connector of claim 1 wherein:

the wire receiving slots include a first wire receiving slot having a first depth and a second wire receiving slot having a second depth, the second depth greater then the first depth.

5. The connector of claim 1 further comprising:

at least one clip positioned in the lacing cap subassembly, the at least one clip including a coupling section to secure the at least one clip to the lacing cap subassembly, a resilient biasing section and at least one barb positioned to contact a cable.

6. The connector of claim 5 wherein:

the at least one clip comprises a first clip and a second clip, the first clip secured to the lacing cap body and the second clip secured to the lacing cap door.

7. The connector of claim 5 further comprising:

a shell, the shell receiving the modular connector subassembly and the lacing cap subassembly.

8. The connector of claim 7 wherein:

the at least one clip comprises a bump to make electrical contact with the shell.

9. A lacing cap assembly including:

a lacing cap having a plurality of wire receiving slots;

a lacing cap body coupled to the lacing cap;

a lacing cap door hingedly coupled to the lacing cap body, the lacing cap door moveable between an open and closed position;

at least one clip positioned in the lacing cap assembly, the at least one clip including a coupling section to secure the at least one clip to the lacing cap assembly.

10. The assembly of claim 9 wherein:

the lacing cap includes a first opening in a sidewall thereof sized to receive a cable;

and the lacing cap body includes a second opening in a sidewall thereof sized to receive the cable;

the first opening positioned adjacent to the second opening.

11. The assembly of claim 10 wherein:

the lacing cap door allows and prevents access through the second opening.

12. The assembly of claim 9 wherein:

the wire receiving slots include a first wire receiving slot having a first depth and a second wire receiving slot having a second depth, the second depth greater then the first depth.

13. The assembly of claim 9 wherein:

the at least one clip comprises a first clip and a second clip, the first clip secured to the lacing cap body and the second clip secured to the lacing cap door.

14. The assembly of claim 9 wherein:

the at least one clip comprises a bump to make electrical contact with the shell.

15. The assembly of claim 9 wherein:

the at least one clip has a resilient biasing section and at least one barb positioned to contact a cable.

* * * * *